430-57
SR
6/23/87 X3 4,675,264

United States Patent [19]
Kawamura et al.

[11] Patent Number: 4,675,264
[45] Date of Patent: Jun. 23, 1987

[54] ELECTROPHOTOGRAPHIC SENSITIVE MEMBER WITH AMORPHOUS SI BARRIER LAYER

[75] Inventors: Takao Kawamura, 17-11, Takakura-dai 1-chome, Sakai-shi, Osaka; Hideaki Iwano, Kagoshima; Naooki Miyamoto, Kagoshima; Yasuo Nishiguchi, Kagoshima, all of Japan

[73] Assignees: Kyocera Corporation; Takao Kawamura, both of Kyoto, Japan

[21] Appl. No.: 885,923

[22] Filed: Jul. 15, 1986

Related U.S. Application Data

[63] Continuation of Ser. No. 594,201, Mar. 28, 1984, abandoned.

[30] Foreign Application Priority Data

Apr. 1, 1983 [JP] Japan ..... 58-58292
Jan. 24, 1984 [JP] Japan ..... 59-11495

[51] Int. Cl.[4] ..... G03G 5/082; G03G 5/14
[52] U.S. Cl. ..... 430/65; 430/57; 430/66; 430/67
[58] Field of Search ..... 430/57, 60, 65, 66, 430/67

[56] References Cited

U.S. PATENT DOCUMENTS 4,443,529 4/1984 Kanbe et al. ..... 430/67 X
4,486,521 12/1984 Misumi et al. ..... 430/65
4,489,149 12/1984 Kawamura et al. ..... 430/65
4,547,448 10/1985 Shirai et al. ..... 430/57 X

*Primary Examiner*—Roland E. Martin
*Attorney, Agent, or Firm*—Spensley, Horn, Jubas & Lubitz

[57] ABSTRACT

The invention relates to improvements in an electrophotographic sensitive member having a photoconductive layer formed with amorphous silicon produced by glow discharge decomposition or sputtering. An electrophotographic sensitive member is formed by laminating an amorphous silicon barrier layer and an amorphous photoconductive layer successively on an electrically conductive substrate, the first mentioned layer containing an impurity of Group IIIa of Periodic Table of Elements, or nitrogen and impurity of Group IIIa of same Table, and also containing oxygen within a range of 0.1 to 20.0 atomic % at the point of the layer and in a progressively decreasing pattern throughout the rest thereof. Constructed as such, the photosensitive member has an increased photosensitivity to near-infrared beams, a large charge-holding capability, and low-rate dark attenuation characteristics. In addition, it is less expensive to manufacture.

28 Claims, 8 Drawing Figures

ELECTROPHOTOGRAPHIC SENSITIVE MEMBER WITH AMORPHOUS SI BARRIER LAYER

This is a continuation of application Ser. No. 594,201 filed on Mar. 28, 1984, now abandoned.

BACKGROUND OF THE INVENTION

1. Field of the Invention

This invention relates to improvements in an electrophotographic sensitive member having a photoconductive layer formed with amorphous silicon (hereinafter simply referred to as a-Si) produced by glow discharge decomposition or sputtering techniques.

2. Prior Art

Conventionally, materials such as Se, CdS, and SnO are largely used as photosensitive materials for production of an electrophotographic sensitive member. In recent years, however, the application of a-Si to such photosensitive member has been attracting attention, because a-Si has good advantages in respect of resistance to heat and abrasion, freedom from environmental pollution, and photosensitive characteristics.

For example, in a high-density, high-speed recording system known as laser line printer, which utilizes semiconductor laser beams as recording components and which is compact, light in weight and low power consuming, the oscillation wavelength of the semiconductor laser is in the vicinity of 800 nm within the near infrared region, and therefore, researches for an a-Si photosensitive member having high sensitivity to near-infrared radiation have been made. Already, there has been proposed an a-Si layer added with germanium (hereinafter referred to as Ge) in order to increase the photosensitivity sensitivity to near-infrared beams.

However, such Ge-added a-Si photosensitive member has a disadvantage that its charge holding capability is small and further that it allows dark attenuation at a considerably high speed, which fact has limited the practical application thereof. Another difficulty is that the addition of Ge, which is carried out by glow discharge, involves the introduction of $GeH_4$ gas, which means a considerable increase in production cost because $GeH_4$ gas is very expensive as compared with $SiH_4$.

SUMMARY OF THE INVENTION

This invention, made in view of such situation, is intended to increase the photosensitivity of an a-Si photosensitive member to near-infrared beams. It is another object of the invention to provide an electrophotographic sensitive member which has a large charge-holding capability and low-rate dark attenuation characteristics, and which is inexpensive to manufacture.

The electrophotographic sensitive member in accordance with the invention comprises an electrically conductive substrate and an a-Si barrier large and an a-Si photoconductive layer, both layers laminated on a substrate in order of mention, said a-Si barrier layer containing an impurity of Group IIIa of Periodic Table of Elements, or nitrogen and an impurity of said Group IIIa, said barrier layer containing oxygen within a range of 0.1 to 20.0 atomic % at the start point of its formation and in a progressively decreasing pattern throughout the rest thereof.

BRIEF DESCRIPTION OF THE DRAWINGS

The invention will now be described in detail with reference to the accompanying drawings, in which.

DETAILED DESCRIPTION OF THE INVENTION

Figure 1:
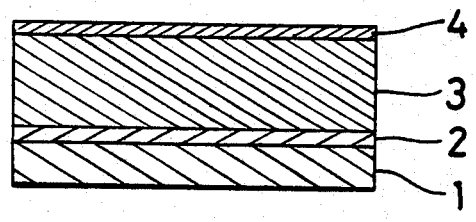
FIG. 1 is an enlarged sectional view of a photosensitive member embodying this invention.

In its basic structure, the electrophotographic sensitive member consists of an electrically conductive substrate and an a-Si barrier layer and an a-Si photoconductive layer laminated successively on the substrate. In a preferred embodiment, as shown in FIG. 1, the photosensitive member consists of an electrically conductive substrate 1, and an a-Si barrier layer 2, an a-Si photoconductive layer 3, and an a-Si surface protective layer 4, said three layers being successively laminated on the substrate, The surface protective layer may not be limited to one formed of a-Si; it may be formed of one of such other materials as will be mentioned hereinafter.

For the purpose of this invention, $N_2O$, NO, $NO_2$, $NH_3+O_2$, or $N_2+O_2$ may be used to allow the layers to contain oxygen and nitrogen.

Where an a-Si surface protective layer 4 is used, the oxygen, nitrogen, hydrogen and boron contents and the thickness of the individual layers may be as shown in Table 1.

TABLE 1

| | Layer thickness (μm) | Oxygen or oxygen and nitrogen nitrogen (atomic %) | Hydrogen cont. (atomic %) | Boron cont. (ppm) |
|---|---|---|---|---|
| Surface protective layer 4 | 0.05~1.0 | (to be described hereinafter) | 10~40 | 0~20,000 |
| Photoconductive layer 3 | 5~100 | $10^{-5}$~$5\times10^{-2}$ | " | 10~20,000 |
| Barrier layer 2 | 0.2~5.0 | (to be described hereinafter) | " | 50~500 |

The barrier layer 2 contains oxygen, or oxygen and nitrogen in a progressively decreasing pattern throughout the formation thereof, such content being 0.1 to 20.0 atomic % oxygen, or 0.1% to 20.0 atomic % oxygen and 0.05 to 10.0 atomic % nitrogen at the start point of the layer formation. Preferably, the oxygen content or oxygen and nitrogen contents of the barrier layer 2 at the ending portion thereof are of same level as the oxygen content or oxygen and nitrogen contents of the photoconductive layer 3.

The oxygen content or oxygen and nitrogen contents of the surface protective layer 4 are such that the oxygen, or if oxygen and nitrogen are contained, at least one of them, is distributed in a progressively increasing pattern throughout the layer, so that the oxygen content or oxygen and nitrogen content at the ending portion of the layer amount to a total of 1.0 to 60.0 atomic %. Preferably, the oxygen content or oxygen and nitrogen contents of the surface protective layer material at the start point of the layer are of same level as the oxygen content or oxygen and nitrogen contents of the photoconductive layer 3.

It must be noted that the boron content, oxygen content or oxygen and nitrogen contents, and thickness of the barrier layer 2, the oxygen content or oxygen and nitrogen contents of the photoconductive layer 3, and the oxygen content or oxygen and nitrogen contents, and thickness of the surface protective layer 4, are all very important in this invention.

The barrier layer 2 has a function of transporting carriers produced in the photoconductive layer 3 smoothly to the electrically conductive substrate 1 and also of inhibiting the injection of electric charges from the substrate 1. Furthermore, since the layer 2 contains boron and since its oxygen content or oxygen and nitrogen contents are distributed in progressively greater proportions in the layer as compared with such content or contents of the photoconductive layer 3, the oxygen, nitrogen and boron contents and their quantitative ratios may be within certain ranges favorable enough to permit increased photosensitivity to near infrared beams, presumably though.

Indeed, without barrier layer 2, there is no effective blocking against electric charge injection from the electrically conductive substrate 1, and as a consequence, the surface potential drops, dark attenuation takes place faster, and the photosensitivity to near infrared beams is relatively low.

It is also noted that if the oxygen content or oxygen and nitrogen contents of the barrier layer 2 is evenly distributed over the thickness of the layer, even though such content is larger than that of the photoconductive layer 3, no substantial photosensitivity to near infrared beams is obtainable. It is further noted that even if such content is distributed with variation relative to the thickness of the barrier layer 2 as aforesaid, it is not possible to obtain any substantial photosensitivity to near infrared radiation, unless an impurity, such as boron, of Group IIIa of Periodic Table is contained in the layer. With reference to the boron content of the barrier layer 2, it is noted that if such content is less than 50 ppm, no sufficient photosensitivity to near infrared beams is obtainable, whilst if it is more than 500 ppm, no sufficient surface potential is available and the speed of dark attenuation becomes greater. Therefore, the boron content of the barrier layer 2 should be within the range of 50 to 500 ppm, or preferably 80 to 150 ppm.

Further, it has been found that with a barrier layer 2 formed in such a way that the layer, throughout the formation thereof, contains an impurity of Group IIIa of Periodic Table and has an oxygen content distributed in a progressively decreasing pattern, with no nitrogen content, it is certainly possible to obtain increased photosensitivity to near infrared radiation, but that such photosensitivity can be further increased if the oxygen is distributed together with nitrogen in such progressively decreasing pattern.

Throughout the formation of said barrier layer 2, the oxygen content of the layer should be distributed in a progressively decreasing pattern, the layer containing 0.1 to 20.0 atomic % of oxygen at the start point thereof, and its oxygen content at its ending portion being preferably of same level as that of the photoconductive layer 3. In this connection it is noted that if the oxygen content at the start point of the layer is less than 0.1 atomic %, no effective blocking of the charge injection from the electrically conductive substrate 1 is possible, with the result that no sufficient surface potential is available and dark attenuation becomes faster, whilst if the initial oxygen content is more than 20.0 atomic %, optical carriers are trapped and residual potential is increased. Therefore, the oxygen content at the start point of the layer formation should be within the range of 0.1 to 20.0 atomic %.

Similarly, the nitrogen content of the barrier layer 2 is distributed in a progressively decreasing pattern throughout the formation thereof, with a starting level of 0.05 to 10.0 atomic %. Preferably, the nitrogen content at the ending portion of the larger should be of same level as that of the photoconductive layer 3.

If the initial nitrogen content is outside said range, the presence of nitrogen does not serve for improvement in photosensitivity. Especially where such content exceeds 10.0 atomic %, it has been found, optical carriers are trapped and residual potential tends to increase.

Accordingly, it has been confirmed that if layer formation is started with an oxygen content or oxygen/nitrogen content within the aforesaid range and if such content is progressively decreased to a level comparable to the oxygen content of the photoconductive layer 3, the photosensitivity to the entire near-infrared region can be remarkably increased. Referring to the thickness of the barrier layer 2, it is noted that if the thickness is less than 0.2 μm, no sufficient blocking against charge injection from the electrically conductive substrate 1 is possible, whilst if it exceeds 5.0 μm, residual potential will increase. Therefore, the thickness of the barrier layer 2 should be within the range of 0.2 to 5.0 μm.

Further, it has been found that where the oxygen content or oxygen and nitrogen content of the barrier layer 2 is maximal at the interface between the layer and the electrically conductive substrate 1, and if the thickness of the interface portion having the maximal oxygen content or oxygen and nitrogen contents is reduced nearly to zero by gradually decreasing such content of that portion, the barrier layer exhibits very favorable characteristics, with no occurrence of carriers generated in the photoconductive layer 3 being trapped at said interface and with a notable decrease in residual potential.

According to the finding, if the thickness of the maximal oxygen or oxygen/nitrogen containing portion is less than 1,000 Å, there will occur no such phenomenon as fogging in white with an electrographic image that may be attributable to residual potential. More advantageously, if the thickness is less than 10 Å, the presence of residual potential can be effectively prevented which will cause decreased photosensitivity to near infrared beams.

Referring to the photoconductive layer 3, if its content of oxygen, or where it contains oxygen and nitrogen, its content of at least one of them, is more than $5\times10^{-2}$ atomic %, the photosensitivity may be considerably decreased, whilst on the other hand if such content is less than $10^{-5}$ atomic %, the electronegativity of the oxygen atoms or oxgen and nitrogen atoms is too larger to allow incorporation of electrons in dangling bond into the layer, and therefore it is impossible to obtain an a-Si photoconductive layer 3 having a dark resistance of more than $10^{13}$ Ωcm. Accordingly, the oxygen content of the photoconductive layer 3, or if the layer contains both oxygen and nitrogen, its content of at least one of them, should be within the range of $10^{-5}$ to $5\times10^{-2}$ atomic %.

In addition, the photoconductive layer 3 preferably contains at least 200 ppm or more of an impurity, or more particularly boron, of Group IIIa of Periodic Table, because a boron content of such degree will allow the layer 3 to have high photosensitivity to both positive and negative polarities.

Referring next to the surface protective layer 4, its oxygen content, or if the layer contains both oxygen and nitrogen, its content of at least one of them, should be increased on the outer surface of the layer so that $SiO_2$ or $Si_3N_4$ is formed over the outer surface. Thus, a surface protective layer 4 having a high degree of surface hardness can be obtained which will considerably contribute to the increased durability of the photosensitive member. Further, it is desirable that the layer 4 should have an oxygen content or oxygen and nitrogen content, at the start of its formation, which is comparable to that of the photoconductive layer 3 and that the oxygen content or oxygen and nitrogen content of the layer 4 at the ending portion of its formation should be within a range of 1.0 to 60.0 atomic %. Provision of such layer 4 permits the photosensitive member to maintain high photosensitivity and to have improved charge holding capability.

With reference to the thickness of the surface protective layer 4, it is noted that if the thickness is less than 0.05 μm, no improved durability is obtainable, surface potential available is unsatisfactorily low, and no improvement can be seen in charge holding capability. On the other hand, if the thickness is more than 1.0 μm, the photosensitivity tends to decrease and there is an increased possibility of residual potential being present. Therefore, the thickness of the surface protective layer 4 should be within the range of 0.05 to 1.0 μm.

The thickness of the surface protective layer 4 may be determined so that if the maximal oxygen content or oxygen and nitrogen content of the layer at the outer surface thereof is relatively large, the thickness is reduced, and conversely, if such maximal content is relatively small, the thickness is increased, but within aforesaid range in both cases.

If the surface protective layer 4 is formed so that its oxygen content or oxygen and nitrogen content is progressively increased throughout the formation thereof and such increase ends at the outer surface, and if the thickness of the portion having a maximal oxygen content or oxygen and nitrogen cotent is substantially zero, there is little or no likelihood of residual potential being present in the layer and thus a high-quality electrophotographic image can be obtained which is free of fogging in white, is of high contrast, and of good resolution.

The thickness of the photoconductive layer 3 is not strictly of so much importance for the purpose of this invention; it may be within a conventionally accepted range of 5 to 100 μm, for example.

In the electrophotographic sensitive member of this invention, the barrier layer is formed in such a way that at the start of the formation thereof the layer contains 0.1 to 20.0 atomic % of oxygen, or 0.1 to 20.0 atomic % of oxygen plus 0.05 to 10.0 atomic % of nitrogen, with such content being gradually decreased throughout the layer formation, and therefore, the barrier layer is able to transport carriers produced in the photoconductive layer smoothly to the electrically conductive substrate, and to inhibit the entry of electric charge from the substrate. In addition, the oxygen content or oxygen and nitrogen content of the barrier layer serves to improve the photosensitivity to infrared beams. Furthermore, the oxygen content or oxygen and nitrogen content is maximal at the interface between the barrier layer and the electrically conductive layer and is progressively decreased after the interface and throughout the rest of the barrier layer; and therefore, where the thickness of the portion having the maximal oxygen content or maximal oxygen and nitrogen content is substantially zero, residual potential can be completely eliminated and thus a very advantageous electrophotosensitive member can be obtained which is free from the trouble of decreased photosensitivity.

Again, in the surface protective layer formed in succession to the photoconductive layer, its oxygen content or oxygen and nitrogen content is distributed in a progressively increasing pattern throughout the layer so that at the outer surface portion thereof it contains 1.0 to 60.0 atomic % of oxygen or 1.0 to 60.0 atomic % of oxygen and nitrogen combined together; and the resulting formation of $SiO_2$ or $Si_3N_4$ adds considerably to the surface hardness. Needless to say, such arrangement permits the electrophotographic sensitive member to have high photosentivity, and markedly improved charge-holding capabilities.

Next, a glow discharge decomposition apparatus of capacitive coupling type for formation of a-Si layers will be described with reference to FIG. 2.

In the figure, first, second, and third tanks 5, 6, 7 have $SiH_4$, $B_2H_6$, and $O_2$ or $N_2O$ gases enclosed therein. Carrier gas for both $SiH_4$ and $B_2H_6$ gases is hydrogen. These gases are discharged by releasing corresponding first, second, and third regulating valves 8, 9, 10. Gases from the first and second tanks 5, 6 are fed into a first main pipe 14, and $O_2$ or $N_2O$ gas from the third tank 7 is fed into a second main pipe 15, with their flow rates regulated by mass flow controllers 11, 12, 13. Shown by numerals 16, 17 are stop valves. Gases flowing through the first and second main pipes 14, 15 are introduced into reaction tube 18. Around a base plate inside the reaction tube 18, there are disposed capacitive coupling type discharge electrodes 19, of which high-frequency power and frequency may be suitably set at 50 watts to 3 kilowatts and one MHz to several tens MHz.

Inside the reaction tube 18 and on a turntable 22 rotatable by a motor 21 there is mounted a base plate 20 of such material as aluminum or NESA glass on which a-Si films are to be formed. The base plate 20 is uniformly heated by suitable heating means to 50°~300° C., or preferably to 150°~250° C. The interior of the reaction tube 18 in which high vacuum (discharge pressure 0.5 to 2.0 Torr) is required during film forming operation is connected to a rotary pump 23 and to a diffusion pump 24.

Where such glow discharge decomposition apparatus is employed, operation for forming oxygen or oxygen/-nitrogen containing a-Si films on the base plate 20 is carried out by releasing the first and third regulating valves 8, 10 to discharge $SiH_4$ gas from the first tank 5 and $O_2$ or $N_2O$ gas from the third tank 7. In order to have boron contained in the films, the second regulating valve 9 is released to discharge $B_2H_6$ gas from the second tank 6. The rates of discharge are regulated by mass flow controllers 11, 12, 13. $SiH_4$ gas or $SiH_4$-$B_2H_6$ mixture gas is fed through the first main pipe 14, and concurrently $O_2$ gas or $N_2O$ gas of a certain molar ratio to $SiH_4$ through the second main pipe 15, into the reaction tube 18. The interior of the reaction tube 18 is kept vacuum, 0.5 to 2.0 Torr, the temperature of the base plate is maintained at 50° to 300° C., and high-frequency power and frequency for the capacitive type discharge electrodes 19 are set at 50 watts~3 kilowatts and one~several tens MHz. Glow discharge takes place and gases are decomposed, and accordingly on the base plate are formed a-Si films containing oxygen, nitrogen and hydrogen, and also a-Si films containing an appropriate amount of boron, at a rate of about 10 to 2500 Å/min.

To further illustrate this invention the following examples are given.

EXAMPLE 1

By employing the glow discharge decomposition apparatus described above with reference to FIG. 2, an a-Si barrier layer, an a-Si photoconductive layer, and an a-Si surface protective layer were formed to obtain an electrophotographic sensitive member, and spectral sensitivity and surface potential characteristics were measured of the photosensitive member.

A cylindrical aluminum substrate 1 was placed on the turntable 22 in the glow discharge decomposition apparatus. $SiH_4$ gas (at flow rate of 320 SCCM), with hydrogen as carrier gas, was discharged from the first tank 5, $B_2H_6$ gas (at flow rate of 80 SCCM), with hydrogen as carrier gas, from the second tank 6, and oxygen gas (at flow rate of 10.0 SCCM) from the third tank 7, to form a barrier layer on the planished cylindrical aluminum substrate 1. Starting with a composition of about 5.0 atomic % oxygen, about 200 ppm boron, and about 10 atomic % hydrogen, the composition of the barrier layer was gradually varied during the formation thereof by successively decreasing the discharge rate of oxygen gas in such a way that the flow rate of oxygen was 0.6 SCCM when the layer became 2.0 μm thick, so that the layer had a maximal oxygen content adjacent the interface of the substrate and had an oxygen content close to that of a photoconductive layer 3 as the formation of the barrier layer approached its end. That is, adjustment was made so that the distribution of oxygen in the barrier layer showed an exponential curve relative to the thickness of the layer. Operating conditions during this formation stege were: discharge pressure 0.6 Torr, substrate temperature 200° C., high-frequency power 150 W, and film forming velocity 14 Å/sec.

Following this formation, a photoconductive layer 3 containing about 0.02 atomic % oxygen, about 200 ppm boron, and about 15 atomic % hydrogen was produced under the condition of oxygen gas supply at flow rate of 0.6 SCCM. Subsequently, flow rates were gradually varied in succession: oxygen gas from 0.6 SCCM to 10.0 SCCM, $SiH_4$ gas from 320 SCCM to 100 SCCM, and $B_2H_6$ gas from 80 SCCM to zero, whereby a surface protective layer 4 containing about 50 atomic % oxygen, about 3 atomic % hydrogen, and no boron at the outer surface thereof, and having a thickness of 0.2 μm, was produced.

Figure 3:
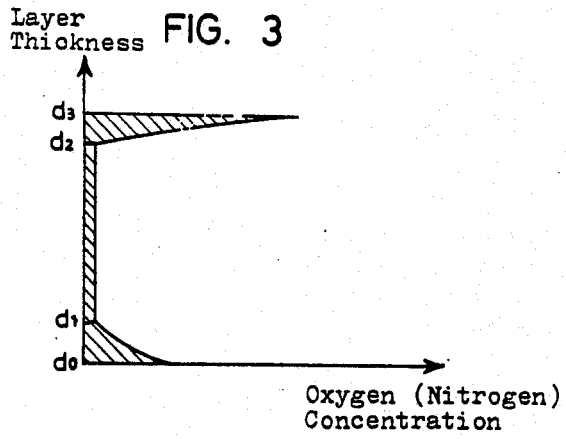
FIG. 3 is a schematic view showing the distribution of oxygen or nitrogen concentrations relative to the layer thickness of the photosensitive member according to the invention.

FIG. 3 presents a schematic view showing the oxygen content distribution relative to layer thickness of a laminated photosensitive member A formed in accordance with the above procedure. In the figure, abscissa axis denotes oxygen concentrations and ordinate axis denotes layer thickness of barrier layer 2 ($d_O$–$d_1$), photoconductive layer ($d_1$–$D_2$), and surface protective layer 4 ($d_2$–$d_3$).

Figure 4:
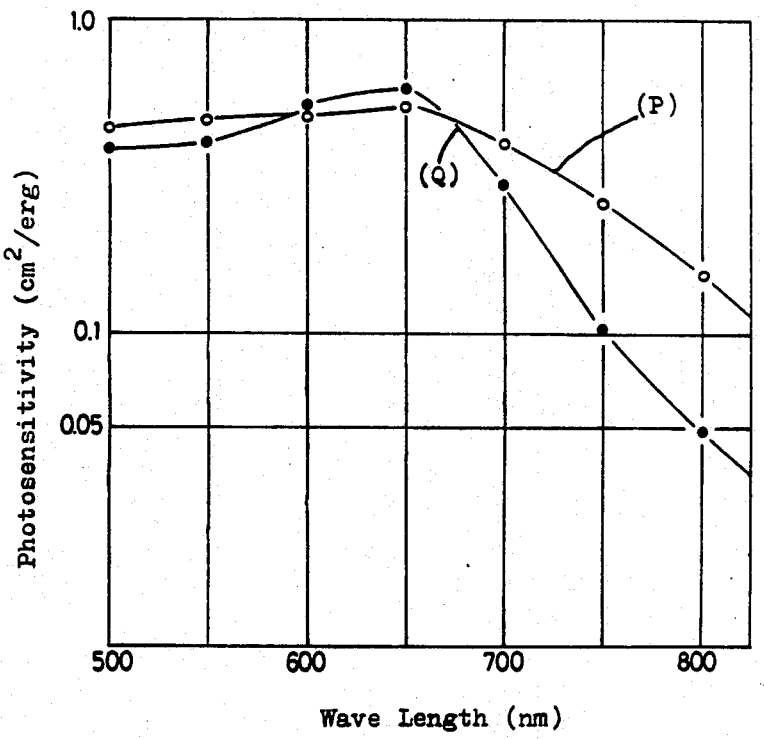
FIGS. 4 and 5 are graphic representations showing spectral photosensitivity curves of laminated amorphous-silicon photosensitive members.

Spectral photosensitivity characteristics of the laminated photosensitive member A thus obtained were measured. Measurement results are shown in FIG. 4.

In the figure, mark O denotes photosensitivity measurements on the laminated photosensitive member A, mark P denotes a spectral photosensitivity curve based on the measurements, mark  denotes photosensitivity measurements on a laminated photosensitive member having no barrier layer 2 (A-1), of which photoconductive layer 3 and surface protective layer 4 were formed under same operating conditions as applied in the present example, and mark Q denotes a spectral photosensitivity curve based on the measurements. As can be clearly understood from FIG. 4, the laminated photosensitive member A embodying the invention, which has such barrier layer 2 as above described, has a remarkable advantage over the photosensitive member A-1 having no barrier layer 2, in photosensitivity characteristics in long wave length region, thus assuring its availability for application to laser beam printers using semiconductor laser.

Figure 6:
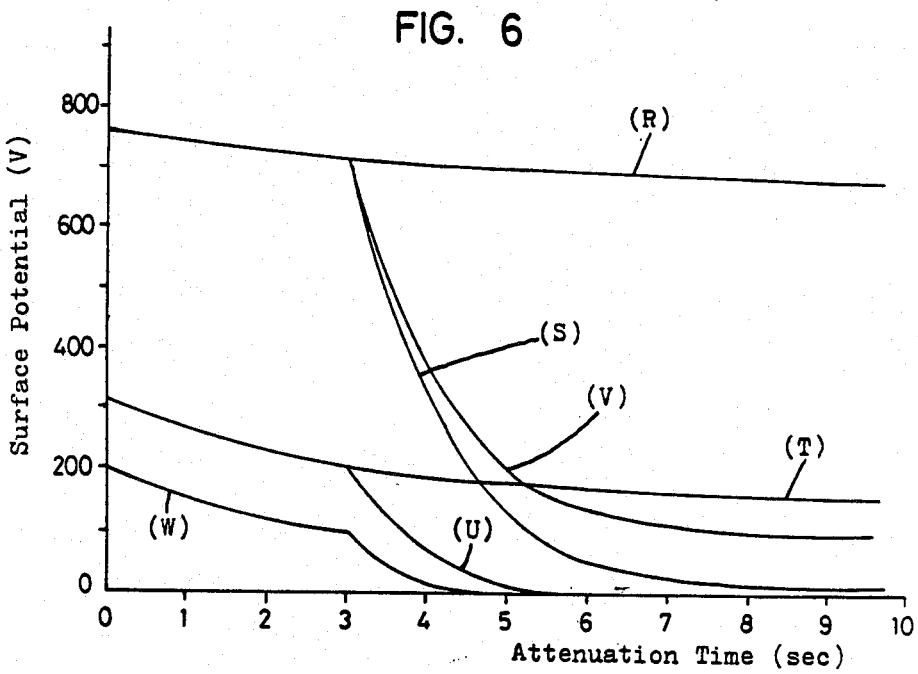
FIGS. 6 and 7 are graphs showing surface potentials, dark attenuation curves, and optical attenuation curves of laminated amorphous-silicon photosensitive members.

Again, measurements were made as to the dark and optical attenuation characteristics of the laminated photosensitive member A according to the invention. Measurement results are shown in FIG. 6. The characteristics shown are based on the observation of changes with time in surface potential in the dark after positive electrification with a +5.6 KV corona charger in the dark, and changes with time in surface potential immediately after 770 nm monochromatic light irradiation. In the figure, R and S denote dark and optical attenuation curves with respect to the laminated photosensitive member A of the invention, and T and U denote dark and optical attenuation curves with respect to a single-layer photosensitive member A-2, one without barrier layer and surface protective member.

As is apparent from FIG. 6, whereas in the single-layer photosensitive member A-2, surface potential is about 300 V and shows about 20~30% dark attenuation in 5 sec, the laminated photosensitive member A of this invention has a notable advantage in charge holding capability over the single-layer one, with surface potential as high as 700 V, and a low rate of dark attenuation, about 5% in 5 sec.

In the photosensitive member A-1 having no barrier layer, as is the case with the single-layer one A-2, surface potential is about 300 V. In FIG. 6, the member A-1 shows substantial same dark-attenuation characteristics as those of the single-layer one A-2.

Printing tests were made with a semiconductor printer (wave length 770 nm, printing velocity 20 copies/min) using the laminated photosensitive member A. A high-quality image having a high contrast and a high degree of resolution was obtained. Even after a 300 thousand cycle repeat test, no deterioration was observed such as decreased density, fogging in white, or void due to drum-surface flaw, and exceptional durability of the photosensitive member A was confirmed.

EXAMPLE 2

Figure 2:
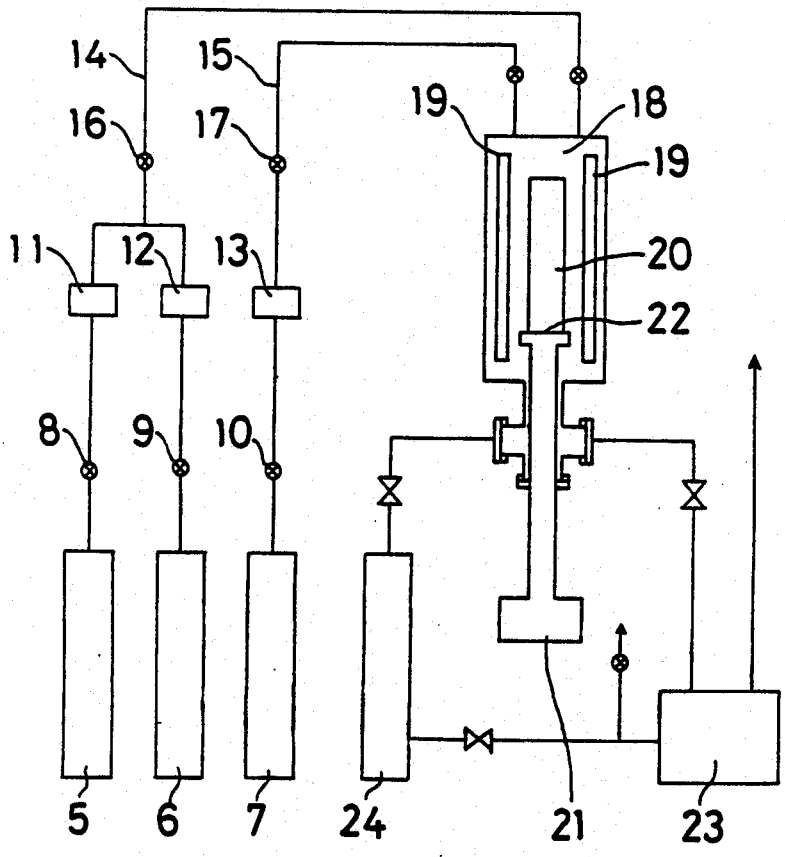
FIG. 2 is a glow discharge decomposition apparatus for producing amorphous silicon layers.

By employing the glow discharge decomposition apparatus described in Example 1 with reference to FIG. 2, an a-Si barrier layer, an a-Si photoconductive layer, and an a-Si surface protective layer were formed to obtain an electrophotographic sensitive member, and spectral sensitivity and surface potential characteristics were measured of the photosensitive member.

A cylindrical aluminum substrate 1 was placed on the turntable 22 in the glow discharge decomposition apparatus. $SiH_4$ gas (at flow rate of 320 SCCM), with hydrogen as carrier gas, was discharged from the first tank 5, $B_2H_6$ gas (at flow rate of 80 SCCM), with hydrogen as carrier gas, from the second tank 6, and $N_2O$ gas (at flow rate of 20 SCCM) from the third tank 7, to form a barrier layer on the planished cylindrical aluminum substrate 1. Starting with a composition of about 5.0 atomic % oxygen, about 0.7 atomic % nitrogen, about 200 ppm boron, and about 10 atomic % hydrogen, the composition of the barrier layer was gradually varied during the formation thereof by successively decreasing the discharge rate of $N_2O$ gas in such a way that the flow rate of $N_2O$ gas was 1.2 SCCM when the layer became 2.0 μm thick, so that the layer had a maximal oxygen and nitrogen content adjacent the interface of the substrate and each had content of oxygen and nitrogen close to that of a photoconductive layer 3 as the formation of the barrier layer approached its end. That is, adjustment was made so that the distribution of $N_2O$ in the barrier layer showed an exponential curve relative to the thickness of the layer. Operating conditions during this formation stage were: discharge pressure 0.6 Torr, substrate temperature 200° C., high-frequency power 150 W, and film forming velocity 14 Å/sec.

Following this formation, a photoconductive layer 3 containing about 0.02 atomic % oxygen, about 0.003 atomic % nitrogen, about 200 ppm boron, and about 15 atomic % hydrogen was produced under the condition of $N_2O$ gas supply at flow rate of 1.2 SCCM. Subsequently, flow rates were gradually varied in succession: $N_2O$ gas from 1.2 SCCM to 20 SCCM, $SiH_4$ gas from 320 SCCM to 100 SCCM, and $B_2H_6$ gas from 80 SCCM to zero, whereby a surface protective layer 4 containing about 50 atomic % oxygen, about 7 atomic % nitrogen, about 3 atomic % hydrogen, and no boron at the outer surface thereof, and having a thickness of 0.2 μm, was produced.

The distribution of oxygen or nitrogen concentration relative to layer thickness in the laminated photosensitive member A' formed as above described is schematically shown in FIG. 3, in which abscissa axis represents oxygen or nitrogen concentration.

Spectral photosensitivity characteristics of the photosensitive member A' thus produced were measured. The results are shown in Table 5.

In the figure, mark ● denotes photosensitivity measurements on the laminated photosensitive member A', mark P denotes a spectral photosensitivity curve based on the measurements, mark X denotes photosensitivity measurements on a laminated photosensitive member having no barrier layer 2 (A'-1), of which photoconductive layer 3 and surface protective layer 4 were formed under the same operating conditions as applied in the present example, and mark Q denotes a spectral photosensitivity curve based on the measurements. Again, another test sample was produced by discharging oxygen gas, in place of $N_2O$, from the third tank 7, and by controlling flow rates so that the oxygen, boron and hydrogen contents of the individual layers, distribution of such contents, and thickness of each individual layer agreed with those of the photosensitive member A'. Thus, a laminated photosensitive member A'-2 was obtained which was different from said member A' only in that no nitrogen was contained. Mark ○ indicates photosensitivity measurements with respect to the photosensitive member A'-2, and R indicates a spectral photosensitivity curve based on the measurements.

Figure 5:
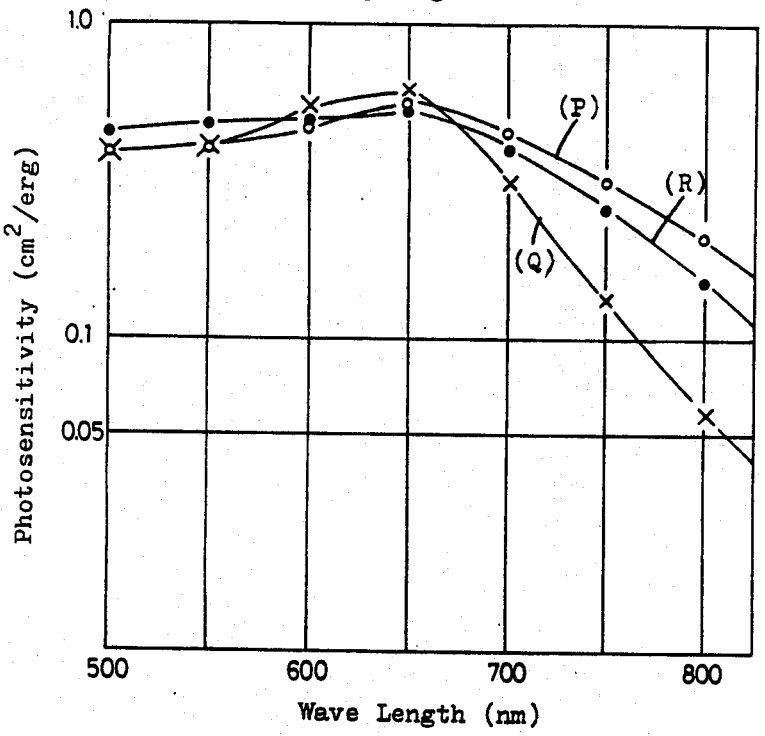

As can be clearly understood from FIG. 5, the laminated photosensitive member A embodying the invention, which has such barrier layer 2 as above described, has a remarkable advantage over the photosensitive member A'-1 having no barrier layer 2, in photosensitivity characteristics in long wave length region, thus assuring its availability for application to laser beam printers using semiconductor laser. It was found that where nitrogen was contained, further improvement was obtainable in photosensitivity characteristics in long-wave number regions, as compared with Example 1.

Figure 7:
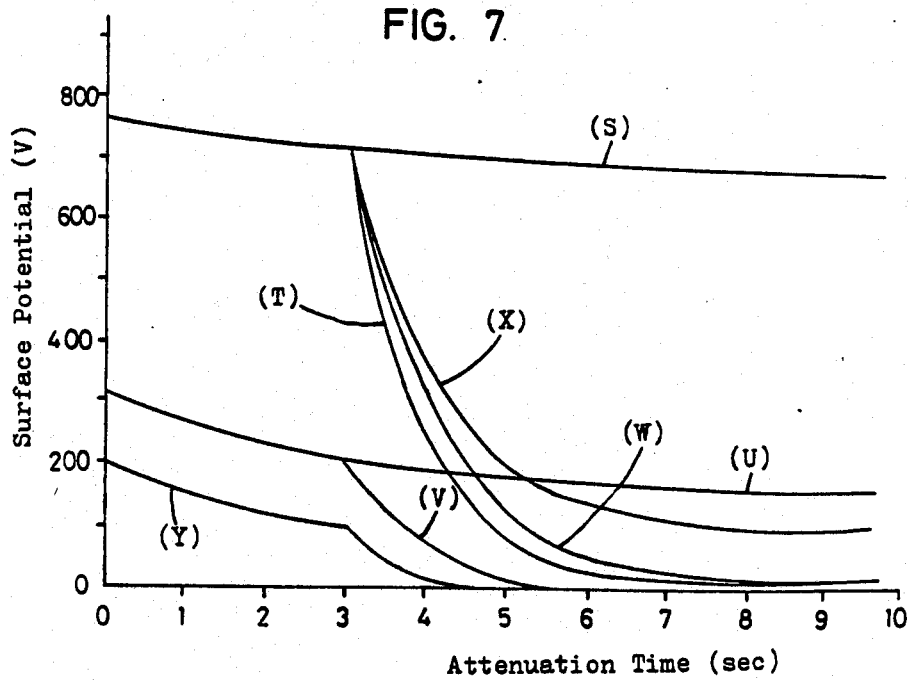

Again, measurements were made as to the dark and optical attenuation characteristics of the laminated photosensitive member A' according to the invention. Measurement results are shown in FIG. 7. As in the case of Example 1, the characteristics shown are based on the observation of changes with time in surface potential in the dark after positive electrification with a +5.6 KV corona charger in the dark, and changes with time in surface potential immediately after 770 nm monochromatic light irradiation. In the figure, S and T denote dark and optical attenuation curves with respect to the laminated photosensitive member A' of the invention, and U and V denote dark and optical attenuation curves with respect to a single-layer photosensitive member A' - 3, one without barrier layer and surface protective member.

As is apparent from FIG. 7, whereas in the singlelayer photosensitive member A' - 3, surface potential is about 300 V and shows about 20~30% dark attenuation in 5 sec, the laminated photosensitive member A' of this invention has a notable advantage in charge holding capability over the single-layer one, with surface potential as high as 700 V, and a low rate of dark attenuation, about 5% in 5 sec.

Further, the photosensitive member having no barrier layer (A' - 1) showed a surface potential of about 300 V, a level similar to that of the single-layer photosensitive member A' - 3, and exhibited characteristics similar to the dark attenuation curve U. The photosensitive member having no nitrogen dope A' - 2 showed a dark attenuation curve similar to that of the photosensitive member A' employing the invention. Its optical attenuation curve is shown by character W in FIG. 7.

Said laminated photosensitive member A' was employed in a semiconductor laser printer (wave length 770 nm, printing velocity 20 copies/min) and printing tests were made. Results obtained were similar to those with the photosensitive member A in Example 1.

EXAMPLE 3

In same manner as in Example 1, laminated photosensitive members B–J employing this invention were fabricated as per Table 2.

TABLE 2

| * | Barrier layer: Oxygen cont. at substrate interface (atomic %) | Barrier layer: Boron cont. (ppm) | Barrier layer: Thickness (μm) | Photoconductive layer: Oxygen cont. (atomic %) | Photoconductive layer: Boron cont. (ppm) | Photoconductive layer: Thickness (μm) | Surface protective layer: Outer surface oxgen cont. (atomic %) | Surface protective layer: Thickness (μm) |
|---|---|---|---|---|---|---|---|---|
| B | 0.5 | 100 | 4.0 | 0.02 | 100 | 20.1 | 50 | 0.2 |
| C | 5.0 | 100 | 2.0 | 0.02 | 100 | 19.5 | 50 | 0.2 |
| D | 16.0 | 100 | 0.4 | 0.02 | 100 | 19.6 | 50 | 0.2 |
| E | 10.0 | 65 | 2.0 | 0.02 | 100 | 20.0 | 50 | 0.2 |
| F | 10.0 | 400 | 2.0 | 0.01 | 100 | 19.6 | 50 | 0.2 |
| G | 10.0 | 100 | 2.0 | 0.02 | 100 | 19.6 | 60 | 0.08 |
| H | 10.0 | 100 | 2.0 | 0.02 | 100 | 19.5 | 50 | 0.2 |
| I | 10.0 | 100 | 2.0 | 0.02 | 100 | 19.8 | 10 | 0.5 |
| J | 10.0 | 100 | 2.0 | 0.02 | 100 | 19.8 | 4 | 0.8 |

*Photosensitive Photosensitive member

Measurements as to photosensitivity (wave length 770 nm) and surface potential characteristics were made with said laminated photosensitive members B~J in same manner as in Example 1. Results are as shown in Table 3.

TABLE 3

| * | Photosensitivity $E_{50}$ ($cm^2$/erg) (770 nm) | Surface potential (V) | Dark attenuation rate in 5 sec (%) |
|---|---|---|---|
| B | 0.18 | 640 | 5.5 |
| C | 0.21 | 710 | 6.3 |
| D | 0.15 | 780 | 5.0 |
| E | 0.15 | 620 | 6.2 |
| F | 0.21 | 580 | 7.5 |
| G | 0.20 | 700 | 5.0 |
| H | 0.20 | 720 | 5.5 |
| I | 0.21 | 680 | 6.8 |
| J | 0.20 | 700 | 5.0 |

*Photosensitive member

Again, each of the photosensitive members in this example was mounted in a semiconductor laser printer (wave length 770 nm, printing speed 20 copies/min) in same manner as in Example 1, and printing tests were made. In each case, a high-quality image having high contrast and high-degree of resolution was obtained. Even after a 300 thousand cycle repeat test, no image deterioration such as decreased density, fogging in white, or void due to drum-surface flaw, was seen, and the image was found well comparable to the initial one.

EXAMPLE 4

In same manner as in Example 2, laminated photosensitive members B'~K' employing this invention were fabricated as per Table 4.

TABLE 4

| (A)* | Barrier layer: (B)* (atomic %) | Barrier layer: (C)* (atomic %) | Barrier layer: Boron cont. (ppm) | Barrier layer: Layer thickness (μm) | Photoconductive layer: (D)* (atomic %) | Photoconductive layer: (E)* (atomic %) | Photoconductive layer: Boron cont. (ppm) | Photoconductive layer: Layer thickness (μm) | Surface protective layer: (F)* (atomic %) | Surface protective layer: (G)* (atomic %) | Surface protective layer: Layer thickness (μm) |
|---|---|---|---|---|---|---|---|---|---|---|---|
| B' | 0.5 | 0.07 | 100 | 4.0 | 0.02 | 0.003 | 100 | 20.1 | 50 | 7.0 | 0.2 |
| C' | 5.0 | 0.7 | 100 | 2.0 | 0.02 | 0.003 | 100 | 19.5 | 50 | 7.0 | 0.2 |
| D' | 16.0 | 5.0 | 100 | 0.4 | 0.02 | 0.003 | 100 | 19.6 | 50 | 7.0 | 0.2 |
| E' | 10.0 | 1.5 | 65 | 2.0 | 0.02 | 0.003 | 100 | 20.0 | 50 | 7.0 | 0.2 |
| F' | 10.0 | 1.5 | 400 | 2.0 | 0.01 | 0.002 | 100 | 19.6 | 50 | 7.0 | 0.2 |
| G' | 10.0 | 1.5 | 100 | 2.0 | 0.02 | 0.003 | 100 | 19.6 | 60 | 8.0 | 0.08 |
| H' | 10.0 | 1.5 | 100 | 2.0 | 0.02 | 0.003 | 100 | 19.5 | 50 | 7.0 | 0.2 |
| I' | 10.0 | 1.5 | 100 | 2.0 | 0.02 | 0.003 | 100 | 19.8 | 10 | 1.5 | 0.5 |
| J' | 10.0 | 1.5 | 100 | 2.0 | 0.02 | 0.003 | 100 | 19.8 | 4 | 0.6 | 0.8 |
| K' | 15.0 | 2.0 | 100 | 1.5 | 0.02 | 0.003 | 100 | 25.0 | 60 | 8.0 | 0.3 |

(A)*: Photosensitive member
(B)*: Oxygen content at substrate interface
(C)*: Nitrogen content at substrate interface
(D)*: Oxygen content
(E)*: Nitrogen content
(F)*: Outer surface oxygen content
(G)*: Outer surface nitrogen content Measurements as to photosensitivity (wave length 770 nm) and surface potential characteristics were made with said laminated photosensitive members B'~K' in same manner as in Example 1. Results are as shown in Table 5.

TABLE 5

| (A)* | Photosensitivity $E_{50}$ ($cm^2$/erg) (770 nm) | Surface potential (V) | Dark attenuation rate in 5 sec (%) |
|---|---|---|---|
| B' | 0.22 | 630 | 5.5 |
| C' | 0.26 | 700 | 6.5 |
| D' | 0.21 | 750 | 5.0 |
| E' | 0.19 | 640 | 6.3 |
| F' | 0.25 | 600 | 7.2 |
| G' | 0.25 | 680 | 5.0 |
| H' | 0.26 | 740 | 5.3 |
| I' | 0.27 | 700 | 7.0 |
| J' | 0.25 | 660 | 4.9 |
| K' | 0.24 | 700 | 6.0 |

(A)*: Photosensitive member

Further, each of the photosensitive members in this example was mounted in a semiconductor laser printer (wave length 770 nm, printing velocity 20 copies/min) in same manner as in Example 1, and printing tests were made. Results similar to those in Example 3 were obtained.

REFERENCE EXAMPLE 1

A photosensitive member having layers laminated on an aluminum substrate was produced by employing a glow discharge decomposition apparatus in the manner as described above in Example 1.

A barrier layer in this example is different from the one in Example 1. A cylindrical aluminum substrate was placed on the turntable 22 in the glow discharge decomposition apparatus. $SiH_4$ gas, with hydrogen as carrier gas, was discharged (at flow rate of 320 SCCM) from the first tank 5, $B_2H_6$ gas with hydrogen as carrier gas was discharged (at flow rate of 80 SCCM) from the second tank 6, and oxygen gas (at flow rate of 10.0 SCCM) from the third tank 7, so that a layer containing about 5.0 atomic % of oxygen, about 200 ppm of boron, and about 10 atomic % of hydrogen, and having a thickness of 0.4 μm, was formed on the planished cylindrical aluminum substrate. Then, the discharge rate of oxygen gas was gradually and successively decreased so that the flow rate of oxygen was 0.6 SCCM at the end of barrier layer formation. As a result, a barrier layer 2a having a thickness of 2.0 μm was formed. In an inner portion of the barrier layer 2a that is opposed to the substrate 1, a layer having a maximal oxygen content was formed which contained about 5.0 atomic % of oxygen and had a thickness of 0.4 μm. Then, a photoconductive layer 3 and a surface protective layer 4 were laminated in sequence in the manner as in Example 1, and a laminated photosensitive member A - 3 was thus obtained.

Figure 8:
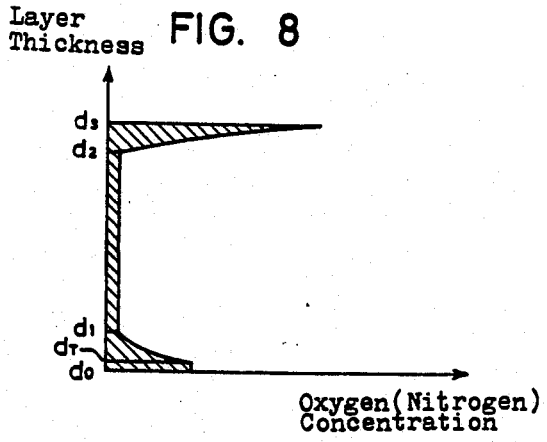
FIG. 8 is a schematic view showing the distribution of oxygen or nitrogen concentrations relative to the layer thickness of a reference laminated photosensitive member.

A schematic view showing the oxygen content distribution relative to layer thickness in the photosensitive member A - 3 is presented in FIG. 8. In the figure, abscissa axis represents oxygen concentration. For ordinate axis, $d_0$–$d_1$ represents thickness of barrier layer 2a, in which $d_0$–$d_T$ represents thickness of the portion having a maximal oxygen content, and $d_T$–$d_1$ thickness of a portion having an oxygen concentration sloped relative to the direction of layer thickness. Parts $d_1$–$d_2$ and $d_2$–$d_3$ represent thicknesses of photoconductive layer 3 and surface protective layer 4.

With the laminated photosensitive member A - 3 thus obtained, measurement was made of its photosensitivity, surface potential, dark attenuation, and optical attenuation characteristics in the same manner as in Example 1. Its photosensitivity and dark attenuation characteristics were not much different from those of the aforesaid photosensitive member A.

As shown by character V in FIG. 6, however, the optical attenuation characteristic of the member A - 3 was such that there involved a residual potential of more than 100 V. This photosensitive member was mounted in the semiconductor laser printer in the same manner as in Example 1 and a printing test was made. The trouble of fogging in white was observed.

REFERENCE EXAMPLE 2

By employing the glow discharge decomposition apparatus in the same manner as in Example 2, a photosensitive member having a barrier layer different from that of Example 2 was formed on an aluminum substrate. A cylindrical aluminum substrate was placed on the turntable 22 in the glow discharge decomposition apparatus. $SiH_4$ gas, with hydrogen as the carrier gas, was discharged (at flow rate of 320 SCCM) from, the first tank 5, $B_2H_6$ gas with hydrogen as the carrier gas was discharged (at flow rate of 80 SCCM) from the second tank 6, and $N_2O$ gas (at flow rate of 20 SCCM) from the third tank 7, so that a layer containing about 5.0 atomic % of oxygen, about 0.7 atomic % of nitrogen, about 200 ppm of boron, and about 10 atomic % of hydrogen, and having a thickness of 0.4 μm, was formed on the planished cylindrical aluminum substrate. Then, the discharge rate of $N_2O$ gas was gradually and successively decreased so that the flow rate of $N_2O$ was 1.2 SCCM at the end of barrier layer formation. As a result, a barrier layer 2a having a thickness of 2.0 μm was formed. In an inner portion of the barrier layer 2a that is opposed to the substrate 1, a layer having a maximal oxygen content was formed which contained about 5.0 atomic % of oxygen and about 0.7 atomic % of nitrogen, and had a thickness of 0.4 μm. Then, a photoconductive layer 3 and a surface protective layer 4 were laminated in sequence in the manner as in Example 2, and a laminated photosensitive member A' - 4 was thus obtained.

A schematic view showing the oxygen content distribution relative to layer thickness in the photosensitive member A' - 4 is presented in FIG. 8. In the figure, the abscissa axis represents oxygen or nitrogen concentration. The ordinate axis, $d_0$–$d_1$ represents thickness of barrier layer 2a, in which $d_0$–$d_T$ represents thickness of the portion having a maximal oxygen or nitrogen content, and $d_T$–$d_1$ represents thickness of a portion having an oxygen and nitrogen concentration sloped relative to the direction of layer thickness. Parts $d_1$–$d_2$ and $d_2$–$d_3$ represent thickness of photoconductive layer 3 and surface protective layer 4.

With the laminated photosensitive member A' - 4 thus obtained, measurement was made of its photosensitivity, surface potential, dark attenuation, and optical attenuation characteristics in the same manner as in Example 2. Its photosensitivity and dark attenuation characteristics were not much different from those of the aforesaid photosensitive member A.

As shown by character X in FIG. 7, however, the optical attenuation characteristic of the member A' - 4 was such that there involved a residual potential of more than 100 V. This photosensitive member was mounted in the semiconductor laser printer in the same manner as in Example 2 and a printing test was made. The trouble of fogging in white was observed.

REFERENCE EXAMPLE 3

By employing a glow discharge decomposition apparatus as shown in FIG. 2, an a-Si.Ge photosensitive layer containing about 40 atomic % of Si and about 40 atomic % of Ge, and having a thickness of 2 μm, and an a-Si photosensitive layer containing about 0.02 atomic % of oxygen, about 200 ppm of boron, and about 15 atomic % of hydrogen, and having a thickness of 20 μm, were sequentially laminated on an electrically conductive substrate, and a photosensitive member having high sensitivity to near infrared beams was obtained.

Said a-Si.Ge members were formed by discharging $SiH_4$ gas (at flow rate of 160 SCCM) and $GeH_4$ gas (at flow rate of 160 SCCM), each with hydrogen as the carrier gas, and under the conditions: discharge pressure 0.6 Torr, substrate temperature 200° C., high-frequency power 150 W, and film forming velocity 14 Å/sec. The a-Si layer was formed under the same conditions as those in Example 1.

The photosensitive member thus obtained was primarily an a-Si.Ge photosensitive member and exhibited high sensitivity to near infrared beams. However, as dark attenuation curve W in FIG. 6 or dark attenuation curve Y in FIG. 7 shows, surface potential was about 200 V, and dark attenuation was very fast, about 50% in 5 sec.

Again, the photosensitive member was mounted in the semiconductor laser printer (wavelength 770 nm, print speed 20 copies/min), and a printing test was made in same manner as in Example 1 or 2. The image obtained was of inferior quality, having a lower degree of contrast as compared with those obtained in Examples 1 to 4.

As can be clearly understood from the above examples, the a-Si photosensitive member in accordance with this invention includes a surface protective layer laminated on a photoconductive layer, said surface protective layer having an oxygen content or oxygen and nitrogen contents distributed in a progressively increasing pattern therein, so that said layer, at the upper end thereof, contains oxygen, or oxygen and nitrogen, at least one of the two, in a maximal proportion and a barrier layer provided between an electrically conductive substrate and the photoconductive layer, said barrier layer having an oxygen content or oxygen and nitrogen content distributed in a progressively increasing pattern toward the substrate, with a density gradient provided in said oxygen content or oxygen and nitrogen content, said barrier layer further containing boron. Therefore, the photosensitive member has substantially large charge holding capabilities, slow dark attenuation characteristics, and remarkably improved photosensitivity.

Furthermore, the photosensitive member is almost free from residual potential possibility, since its oxygen content or oxygen and nitrogen contents are largest at its interface with the substrate and are distributed in a progressively decreasing pattern in the direction opposite from the substrate.

In addition, the photosensitive member of the invention has an advantage that it can be manufactured at low cost because it is unneccessary to use $GeH_4$ or any other Ge gas, which is rather expensive, in order to provide increased photosensitivity to near infrared beams.

What is claimed is:

1. An electrophotographic sensitive member comprising: an electrically conductive substrate, an amorphous silicon barrier layer and an amorphous silicon photoconductive layer, both layers being laminated on the substrate in order of mention, said amorphous silicon barrier layer containing from 50 to 500 ppm of an impurity of Group IIIa of the Periodic Table of Elements, said barrier layer containing from 10 to 40 atomic % of hydrogen, said barrier layer containing oxygen within a range of 0.1 to 20.0 atomic % at the start point of its formation and in a progressively decreasing pattern throughout the rest thereof, said barrier layer being 0.2 to 5.0 microns in thickness, and said photoconductive layer containing both hydrogen within a range of 10 to 40 atomic % and $10^{-5}$ to $10^{-2}$ atomic % of oxygen, wherein the thickness of the barrier layer where the oxygen content is maximal is less than 1000 Å.

2. An electrophotographic sensitive member as claimed in claim 1 wherein said amorphous silicon photoconductive layer contains $10^{-5}$ to $5\times10^{-2}$ atomic % of oxygen.

3. An electrophotographic sensitive member as claimed in claim 1 wherein the oxygen content of said amorphous silicon barrier layer at the ending portion thereof is same as that of said amorphous silicon photoconductive layer.

4. An electrophotographic sensitive member as claimed in claim 1 wherein said amorphous silicon barrier layer contains 10 to 40 atomic % of hydrogen.

5. An electrophotographic sensitive member as claimed in claim 1 wherein said amorphous silicon photoconductive layer contains from 10 to 20,000 ppm of an impurity of Group IIIa of Periodic Table.

6. An electrophotographic sensitive member as claimed in claim 4 or 5 wherein said impurity of Group IIIa of Periodic Table is boron.

7. An electrophotographic sensitive member as claimed in claim 1 wherein said amorphous silicon barrier layer shows the largest oxygen content at the layer thickness of 1000 Å or less.

8. An electrophotographic sensitive member as claimed in claim 1 wherein the oxygen content of said amorphous silicon barrier layer is largest at the interface of the layer with said electrically conductive substrate, being reduced gradually from said interface.

9. An electrophotographic sensitive member as claimed in claim 1 wherein an amorphous silicon surface protective layer is laminated on said amorphous silicon photoconductive layer, said surface protective layer being 0.05 to 1.0 μm in thickness.

10. An electrophotographic sensitive member as claimed in claim 9 wherein said amorphous surface protective layer contains oxygen in a progressively increasing pattern throughout its formation and to a level of 1.0 to 60.0 atomic % at the ending portion thereof.

11. An electrophotographic sensitive member comprising an electrically conductive substrate, an amorphous silicon barrier layer and an amorphous silicon photoconductive layer, both layers being laminated on the substrate in order of mention, said amorphous silicon barrier layer containing nitrogen and 50 to 500 ppm of an impurity of Group IIIa of the Periodic Table of Elements, said barrier layer containing oxygen within a range of 0.1 to 20.0 atomic % at the start point of its formation and in a progressively decreasing pattern throughout the rest thereof, said barrier layer being from 0.2 to 5.0 μm thick, and said amorphous silicon photoconductive layer containing hydrogen within a range of 10 to 40 atomic % and $10^{-5}$ to $10^{-2}$ atomic % of at least either one of oxygen or nitrogen or a mixture of oxygen and nitrogen.

12. An electrophotographic sensitive member as claimed in claim 11 wherein said amorphous silicon barrier layer has a nitrogen content of 0.05 to 10.0 atomic % at the start point of the layer.

13. An electrophotographic sensitive member as claimed in claim 11 wherein said amorphous silicon photoconductive layer contains $10^{-5}$ to $5\times10^{-2}$ atomic % of at least either one of oxygen or nitrogen.

14. An electrophotographic sensitive member as claimed in claim 11 wherein the oxygen and nitrogen contents of said amorphous silicon barrier layer at the ending portion thereof are same as those of said amorphous silicon photoconductive layer.

15. An electrophotographic sensitive member as claimed in claim 11 wherein said amorphous silicon barrier layer contains 10 to 40 atomic % of hydrogen.

16. An electrophotographic sensitive member as claimed in claim 11 wherein said amorphous silicon photoconductive layer contains 10 to 20,000 ppm of an impurity of Group IIIa of the Periodic Table.

17. An electrophotographic sensitive member as claimed in claim 15 or 16 wherein said impurity of Group IIIa of Periodic Table is boron.

18. An electrophotographic sensitive member as claimed in claim 11 wherein said amorphous silicon barrier layer shows the largest oxygen and nitrogen content at the layer thickness of 1000 Å or less.

19. An electrophotographic sensitive member as claimed in claim 11 wherein the oxygen and nitrogen content of said amorphous silicon barrier layer is largest at the interface of the layer with said electrically conductive substrate, being reduced gradually from said interface.

20. An electrophotographic sensitive member as claimed in claim 11 wherein an amorphous silicon surface protective layer is laminated on said amorphous silicon photoconductive layer.

21. An electrophotographic sensitive member as claimed in claim 20 wherein said amorphous silicon surface protective layer has its content of at least either one of oxygen or nitrogen progressively increased throughout the formation thereof.

22. An electrophotographic sensitive member comprising:

an electrically conductive substrate;

an amorphous silicon barrier layer laminated on the substrate, the barrier layer having a thickness ranging from 0.2 to 5.0 microns, the barrier layer containing 10 to 40 atomic % hydrogen and from 50 to 500 ppm of a Group III(a) impurity from 0.1 to 20.0 atomic percent of oxygen at the interface of the barrier layer and the substrate, the atomic percent of oxygen in the barrier layer decreasing from the interface of the barrier layer and the substrate; and, an amorphous silicon photoconductive layer laminated on the barrier layer, the photoconductive layer containing 10 to 40 atomic % of hydrogen and from 0.000001 to 0.05 atomic percent of oxygen or oxygen and nitrogen.

23. An electrophotographic sensitive member according to claim 22 further including a protective layer laminated on the photoconductive layer said protective layer being 0.05 to 1.0 microns in thickness.

24. An electrophotographic sensitive member according to claim 23 wherein the protective layer comprises amorphous silicon and wherein the protective layer contains from 10 to 40 atomic percent hydrogen.

25. An electrophotographic sensitive member according to claim 22 wherein the photoconductive layer has a thickness ranging from 5 to 100 microns and wherein the photoconductive layer contains from 10 to 20,000 parts per million of a Group III(a) impurity.

26. An electrophotographic sensitive member according to claim 22 wherein the oxygen or oxygen plus nitrogen content in the barrier layer at a point farthest from the substrate is approximately equal to the oxygen or oxygen plus nitrogen content in the photoconductive layer at a point closest to the barrier layer.

27. An electrophotographic sensitive member according to claim 23 wherein the oxygen or oxygen plus nitrogen content in the protective layer at a point closest to the photoconductive layer is approximately equal to the oxygen or oxygen plus nitrogen content of the photoconductive layer at a point closest to the protective layer.

28. An electrophotographic sensitive member according to claim 1 wherein the thickness of the barrier layer where the oxygen content is maximal is less than 10 Å.

* * * * *